United States Patent [19]

Gilpatrick et al.

[11] 4,117,577

[45] Oct. 3, 1978

[54] METHOD TO PROTECT FABRIC SELVEDGE ON LOOP PILE CUTTING MACHINE

[75] Inventors: Michael William Gilpatrick, Chesnee, S.C.; Walter Engels, Tryon, N.C.

[73] Assignee: Milliken Research Corporation, Spartanburg, S.C.

[21] Appl. No.: 808,094

[22] Filed: Jun. 20, 1977

Related U.S. Application Data

[62] Division of Ser. No. 714,100, Aug. 13, 1976, Pat. No. 4,069,561.

[51] Int. Cl.[2] ..... D06C 13/08
[52] U.S. Cl. ..... 26/9
[58] Field of Search ..... 26/9, 75; 139/291 C

[56] References Cited

U.S. PATENT DOCUMENTS

| | | | |
|---|---|---|---|
| 1,974,210 | 9/1934 | Fowler | 26/75 |
| 3,925,864 | 12/1975 | Gilpatrick | 26/9 |
| 3,931,669 | 1/1976 | Gilpatrick | 26/9 |
| 3,977,055 | 8/1976 | Gilpatrick | 26/9 |
| 3,977,056 | 8/1976 | Gilpatrick | 26/9 |
| 3,982,309 | 9/1976 | Gilpatrick | 26/9 |
| 4,054,974 | 10/1977 | Engels | 26/9 |

*Primary Examiner*—Robert R. Mackey
*Attorney, Agent, or Firm*—Earle R. Marden; H. William Petry

[57] ABSTRACT

Method to prevent the accidental cutting of the selvedge backing material of a pile fabric being sheared by a rotating cutting apparatus by maintaining the selvedge in a tensioned condition in response to an automatic control which senses the position of the selvedge of the fabric.

1 Claim, 5 Drawing Figures

METHOD TO PROTECT FABRIC SELVEDGE ON LOOP PILE CUTTING MACHINE

This is a division of application Ser. No. 714,100, filed Aug. 13, 1976, now U.S. Pat. No. 4,069,561.

It is an object of the invention to provide a method of efficiently cutting the loops of a loop pile fabric without accidental cutting of the fabric selvedge and/or the backing material.

Other objects and advantages of the invention will become readily apparent as the specification proceeds to describe the invention in which.

Figure 1:
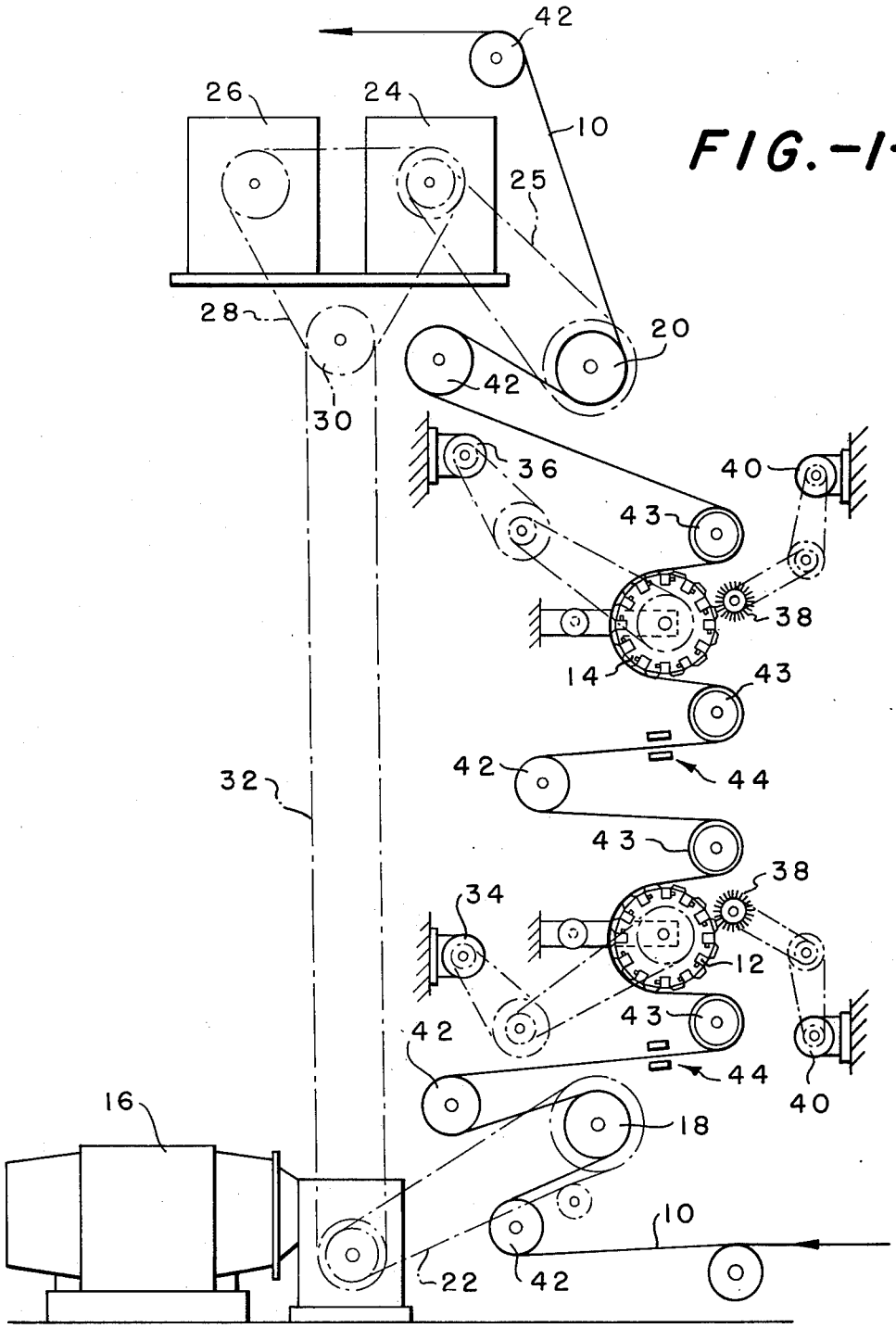
FIG. 1 is an overall schematic view of an apparatus to produce cut loop pile fabric.

Looking now to the drawings and especially FIG. 1, the invention will be described. A loop pile fabric 10, such as tufted or bonded fabric, is supplied from a supply roll (not shown), over rotating cutting rotors 12 and 14 whereat the loops are cut, to a take-up roll (not shown). A motor unit 16 is employed to drive the roll 18 which pulls the loop pile fabric 10 from the supply and to drive the roll 20 to aid in pulling the fabric 10 through the machine.

The roll 18 is driven directly from the motor unit 16 by a suitable pulley belt 22 while the roll 20 is driven from the clutch box 24 by a pulley belt 25. Clutch boxes 24 and 26 transmit power from pulley belt 28 which is driven by sprocket 30 which in turn is driven from the motor unit 16 by pulley belt 32. Clutch box 26 transmits power to another portion of the machine which is not part of the invention.

The cutting rotors 12 and 14 are driven, respectively, by separate motors 34 and 36. Mounted adjacent each of the rotors 12 and 14 is a rotating cleaning brush 38 driven by motor 40 to clean the lint, trash and yarn from the rotors 12 and 14 deposited therein during the loop cutting operation. A plurality of idler rolls 42 and threaded guide bars 43 are employed to guide the fabric 10 through the machine. Schematically represented by reference numeral 44 are edge guide controls 46, preferably of the fluidic type, to adjust the position of the selvedge protectors 48 on each of each of the cutting rotors 12 and 14.

In the preferred form of the invention, it is desired to use at least two loop cutting rotors so that the speed of production can be increased but the number of such rotors is within the scope of the use of the apparatus and does not form part of the invention. The basic use and operation of the cutting rotors 12 and 14 is as set forth in copending U.S. patent application Ser. No. 542,111, filed Jan. 20, 1975 entitled "Pile Fabric Loop Cutting Apparatus" now U.S. Pat. No. 3,977,055, wherein is described the specific action of the cutting blades to cut the loops of a loop pile fabric to produce a cut pile product.

Each of the rotors 12 and 14 has a plurality of rows of cutting blades 50 mounted in slots in the rotors as disclosed in U.S. Pat. application Ser. No. 542,111, supra. Slidably mounted in notches on the collar 52 between each row of cutting blades is a selvedge protector finger 54 having a sawtooth upper surface 56 thereof angled away from the selvedge to provide a lateral pull thereon. All of the fingers 54 on any one end of the rotors are connected to a circular plate or ring 52 which rotates with its respective rotor due to its engagement with collar 58 which is driven with the rotor and rotates with respect to the stub shaft or bushing 60 via suitable bearings 62. Bushing 60 is mounted on rotor shaft 64 through a suitable sleeve bearing and is moved coaxially of the shaft 64 by piston 66 to move the selvedge protectors inwardly and outwardly for reasons hereinafter explained. The piston rod 68 is fixed at 70 by means of a nut and bolt 72 while the piston 66 is fixed to the connecting member 74 which moves the bushing 60 coaxially to move the selvedge protectors 48. To stabilize the sliding movement of the selvedge protectors, the connecting member 74 also moves the bearing member 76 telescoped over the fixed rod 78. Also attached to and movable with the connecting member 74 by means of support bracket 80 is the edge guide sensor 46.

Figure 2:
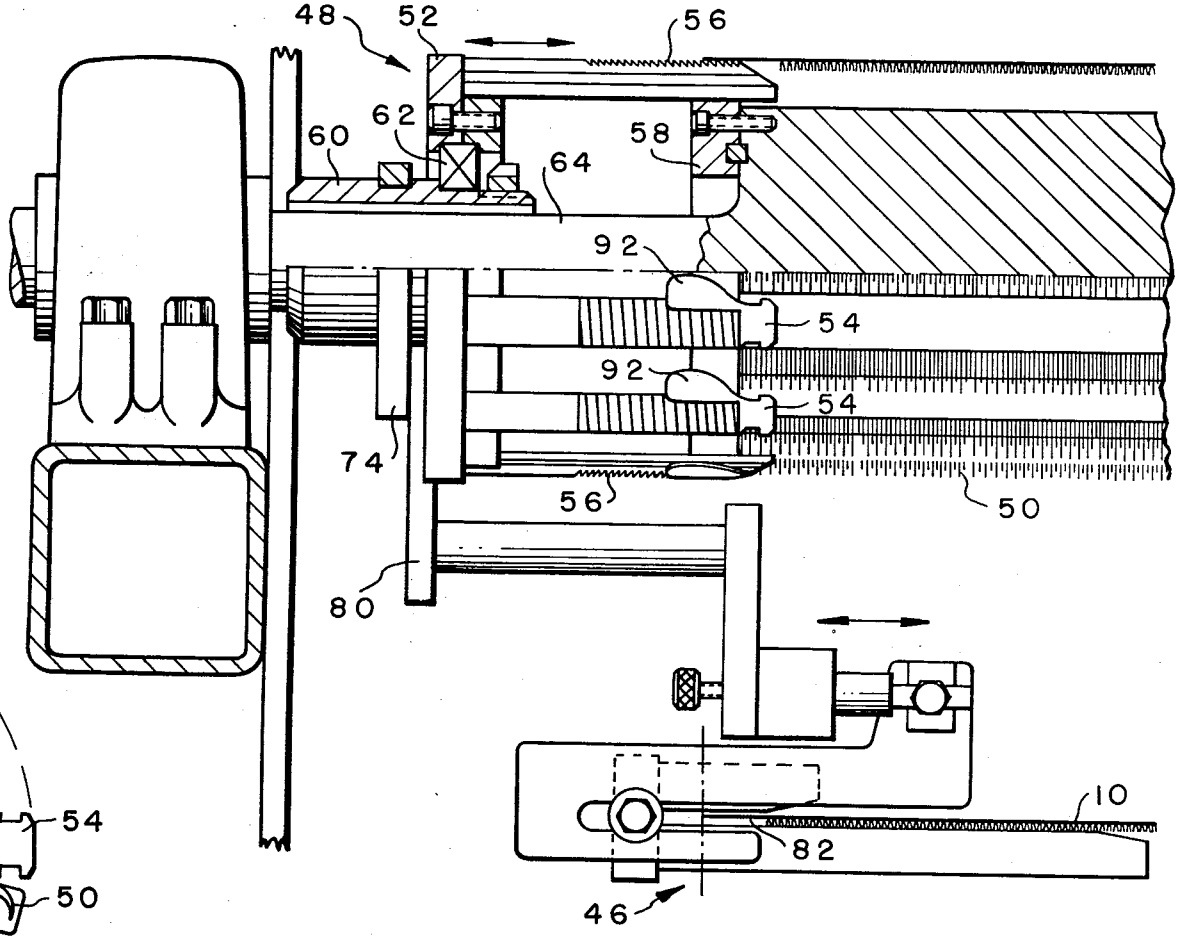
FIG. 2 is an elevational view of a partial section of one of the cutting rotors taken on line 2—2 of FIG. 3.
Figure 4:
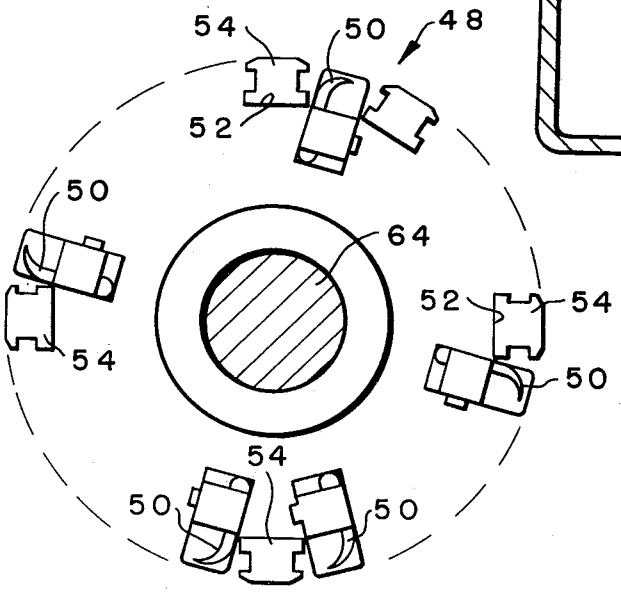
FIG. 4 is an end view of the cutting rotor taken on line 4—4 of FIG. 3.
Figure 3:
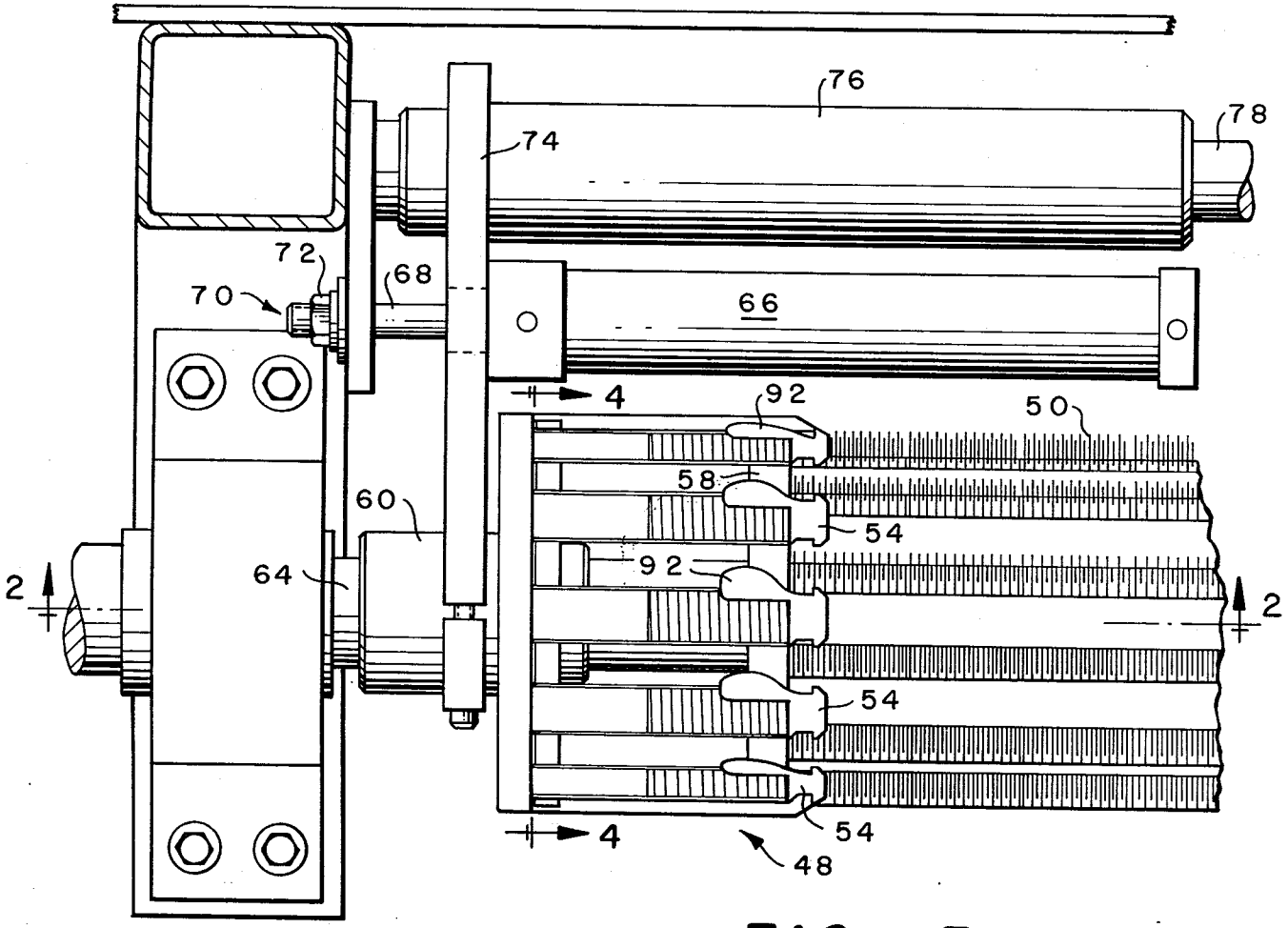
FIG. 3 is a top view of FIG. 2.

As shown in FIGS. 1 and 2, the edge guide sensor 46 is of the fluidic type and depending on the position of the selvedge 82 of the pile fabric 10, changes the pressure on the spring loaded diaphragm 84 to vary the position of the four-way valve 86. Valve 86 contols the flow of fluid from the tank 88 to the double-acting piston 66 to correctly position the selvedge protectors 48 relative to the selvedge 82 of the fabric 10 being sensed. The fluidic sensor 46 is a commercially available type which employs air from a blower 90 to provide the pressure differential to motivate the spring loaded diaphragm 84.

Figure 5:
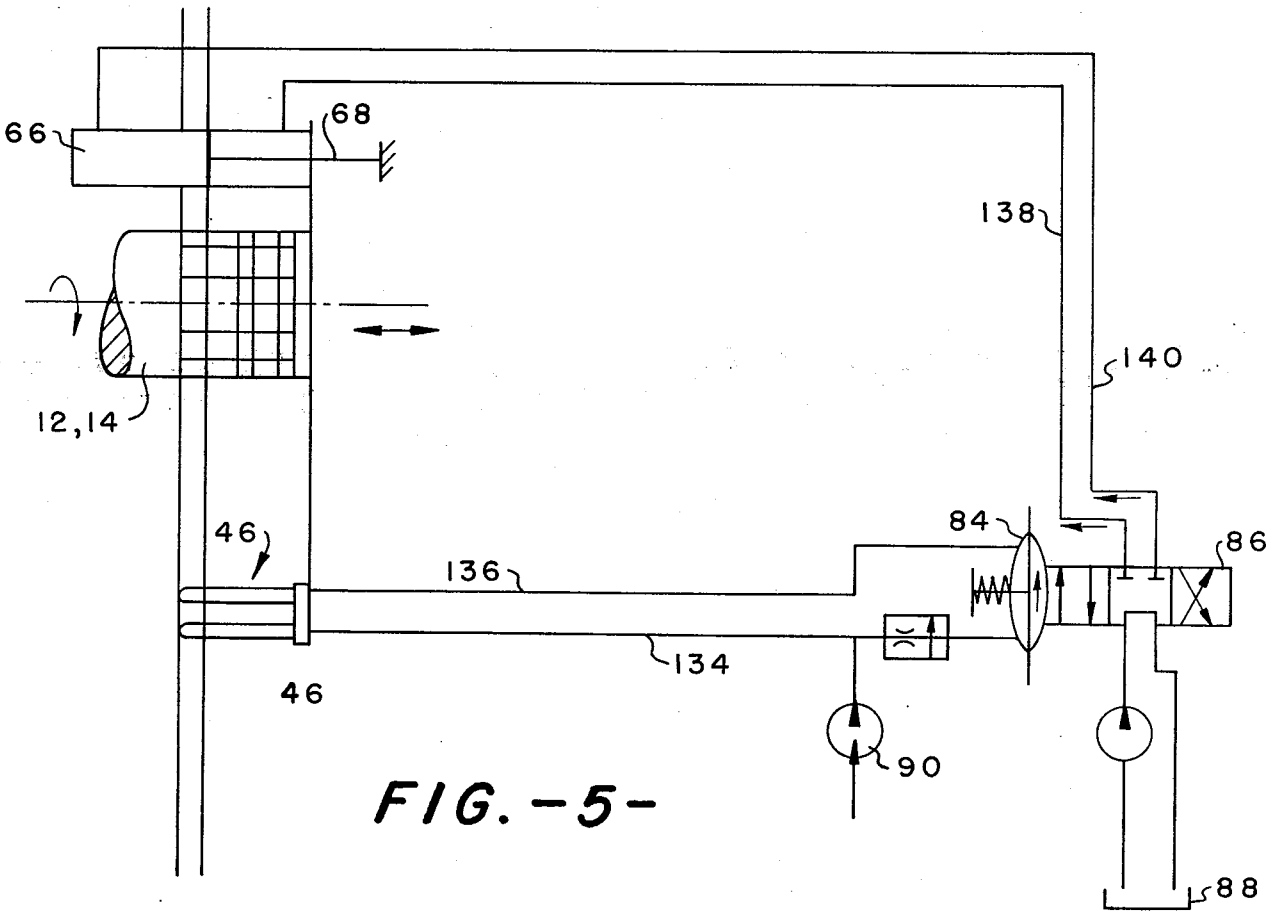
FIG. 5 is a schematic fluidic-hydraulic diagram for the edge guide sensor.

As can be seen in FIGS. 2 and 5, the selvedge 82 is at its desired position so the valve 86 is in its blocked position so fluid from the tank merely circulates from the tank, through the valve and back to the tank. In this condition there is no flow in conduits 138 or 140. Then, if the selvedge should move to the left (FIG. 2), the flow of air from the conduit 134 will be partially blocked from the conduit 136 by the selvedge and the pressure in conduit 136 will be reduced. Reduction of the pressure in conduit 136 reduces the pressure on the left hand side of the diaphragm 84 allowing the pressure on the right hand side of the diaphragm to move the diaphragm 84 to the left causing the valve to assume the left hand position thereby supplying fluid under pressure through conduit 138. Since fluid is being exhausted through conduit 140 to the tank 88, the piston 66, and consequently the selvedge protectors 48, will move outward from the cutting rotors until the edge guide sensor 46 assumes the proper position relative to the selvedge edge 82 as shown in FIG. 2 whereat the diaphragm again assumes the position shown in FIG. 5. Conversely, if the selvedge 82 moves inward towards the rotor, the pressure in conduit 136 will increase moving the valve 86 to the right hand position causing fluid to flow in conduit 140 to move the piston 66 and selvedge protector inward until once again the selvedge edge is detected by the sensor 46. This operation automatically repeats itself depending on the position of the selvedge 82 relative to the edge sensor 46.

Integrally attached to each of the fingers 54 is a projection 92 to prevent the loop pile fabric being cut from falling down between the fingers 54 and the cutting blades during operation.

It can readily be seen that an apparatus has been described that substantially decreases the opportunity for the rotor cutting blades to cut the selvedge of a loop pile fabric being cut by the blades since the disclosed apparatus not only protects the selvedge but also tends to eliminate creases or folds in the fabric being cut.

Although the preferred embodiment of the invention has been described, it is contemplated that changes may be made without departing from the scope or spirit of the invention and it is desired that the invention be limited only by the scope of the claims.

We claim:

1. The method of providing a cut loop pile fabric on a machine having a rotor across which is mounted a plurality of rows of cutting blades comprising the steps of: supplying a web of loop pile fabric having a selvedge area, rotating the rotor, passing the web of loop pile fabric over the rotor with the main body of the loop pile fabric in contact with the cutting blades while providing means to hold the selvedge away from the cutting blades, cutting the loops in the main body of the loop pile fabric while sensing the position of the selvedge to automatically position the means to maintain the selvedge away from the cutting blades and taking up the cut loop pile fabric.

* * * * *